United States Patent [19]

Vargo

[11] 3,989,139

[45] Nov. 2, 1976

[54] DISPLAY CARTON

[75] Inventor: John W. Vargo, Cleveland, Ohio

[73] Assignee: FDI, Inc., Cleveland, Ohio

[22] Filed: July 29, 1975

[21] Appl. No.: 599,983

[52] U.S. Cl. ..... 206/45.31; 206/45.14; 206/521; 229/14 C; 229/34 HW

[51] Int. Cl.[2] ..... B65D 25/54; B65D 65/16

[58] Field of Search ..... 206/45.14, 45.31, 45.34, 206/521; 229/14 C, 16 D, 34 R, 34 HW, 15, 28

[56] References Cited

UNITED STATES PATENTS

| | | | |
|---|---|---|---|
| 2,542,504 | 2/1951 | Gariepy | 229/28 R |
| 2,662,682 | 12/1953 | Bolding | 229/28 R |
| 2,693,308 | 11/1954 | Giroux et al. | 229/28 R |
| 2,700,499 | 1/1955 | Durand | 229/28 R |
| 2,755,982 | 7/1956 | Vander Lugt, Jr. | 206/45.31 |
| 2,884,179 | 4/1959 | Rossum | 229/28 R |
| 3,039,672 | 6/1962 | Kuchenbecker | 229/28 R |
| 3,211,282 | 10/1965 | Hennessey | 229/14 C |

*Primary Examiner*—William Price
*Assistant Examiner*—Bruce H. Bernstein
*Attorney, Agent, or Firm*—Alter and Weiss

[57] ABSTRACT

A display carton for an article of merchandise is formed from a cut and scored blank of paperboard, or the like, and is characterized by upper and lower paired cells protecting the article, the two cells at each end of the completed carton having cell walls in confronting relationship, so that resistance to crushing of the completed carton and good stacking qualities are provided.

9 Claims, 4 Drawing Figures

DISPLAY CARTON

This invention in general relates to cartons for transporting merchandise and more particularly to display type cartons.

The structure according to the invention herein finds application in the display of automotive merchandise, such as oil filter units. These are sealed as a unit and are threaded into position at the engine. It is desirable to protect the filter casing and the threaded fitting at one end thereof. At the same time it is desirable to display the filter while still in the cartons. Thus, the merchandise has to be adequately protected and attractively displayed while using minimum amount of material in fabricating the cartons.

Accordingly, an object of the present invention is to provide new and improved display containers.

Another object of the present invention is to provide a display container designed to be automatically set up from cut and scored blanks.

Yet another object of the present invention is to provide improved display container for cylindrical oil filters, or the like, wherein the filters are nested between protected top and bottom platforms.

Still another object of the present invention is to provide protective display cartons made from axially symmetrical blanks using a minimum of carton material.

According to the invention the unit is held in position for transportation and display between upper and lower platforms or cells, each being comprised of a pair of confronting cell units having abutting central walls affording good stacking strength and protection.

The objects and features of the invention and the manner of obtaining them will become more apparent and the invention itself will be best understood by making reference to the following description of embodiments of the invention taken in conjunction with the accompanying drawings, wherein.

Figure 2:
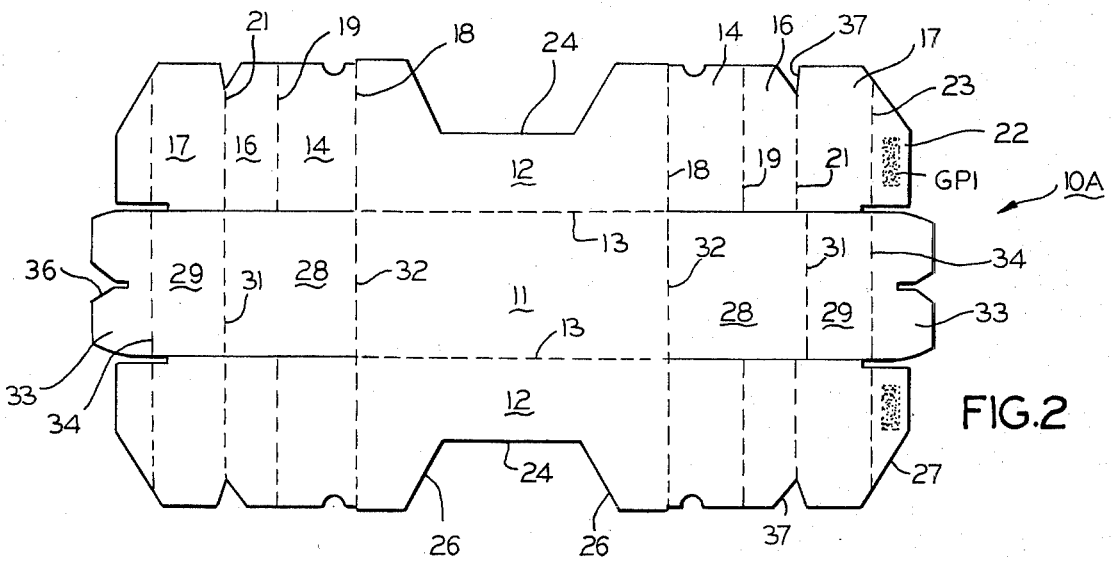
FIG. 2 is a plan view of a cut and scored blank for forming the carton seen in FIG. 1.

The improved display carton according to the present invention is denoted generally by the reference numeral 10 and is adapted to display an article of merchandise A. Carton 10 and article A are preferably enclosed within a shrink film wrap SFW to assure a more attractive and effective carton and to prevent pilfering of article A.

Carton 10 is formed from a cut and scored blank 10A of paperboard or the like and comprises a rectangular back panel 11 having opposed side panels 12 foldably connected thereto along fold lines 13.

Each end of the side panels 12 has foldably connected thereto cell forming elements, these being denoted by reference numerals 14, 16 and 17, foldably connected to each other by fold lines 19 and 21. The cell forming element 14 being foldably connected to side panel 12 along a fold line 18.

A distal closing tab 22 is foldably connected to cell forming element 21 along a fold line 23. It has a glue patch GPI thereon for gluing tab 22 to side panel 12. It should be noted that side wall 12 has a trapezoidal shaped cut out portion 24 with sloping sides 26 thereon. These sides register with sloping ends 27 on the closing tabs 22.

Figure 3:
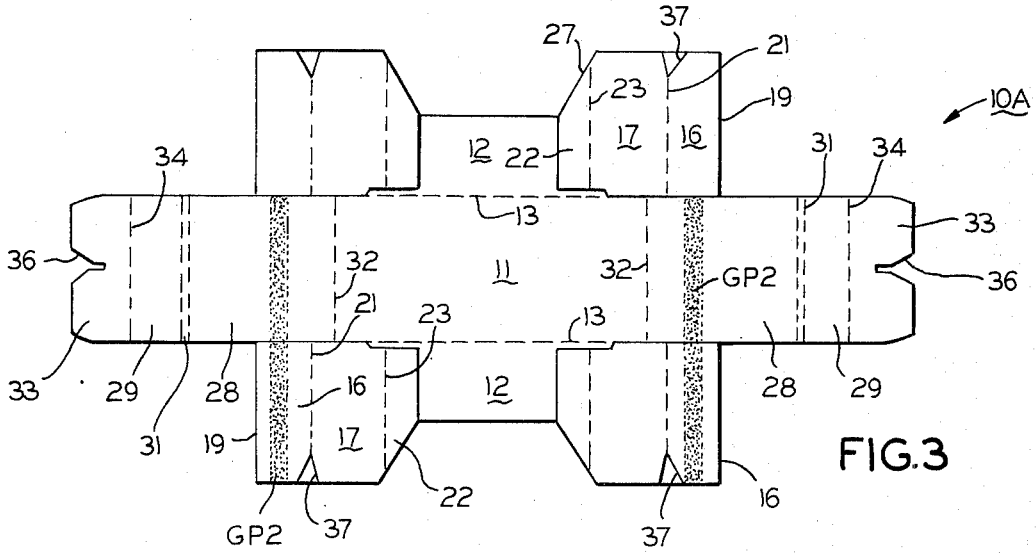
FIG. 3 is a plan view showing a step in folding the blank of FIG. 2.
Figure 4:
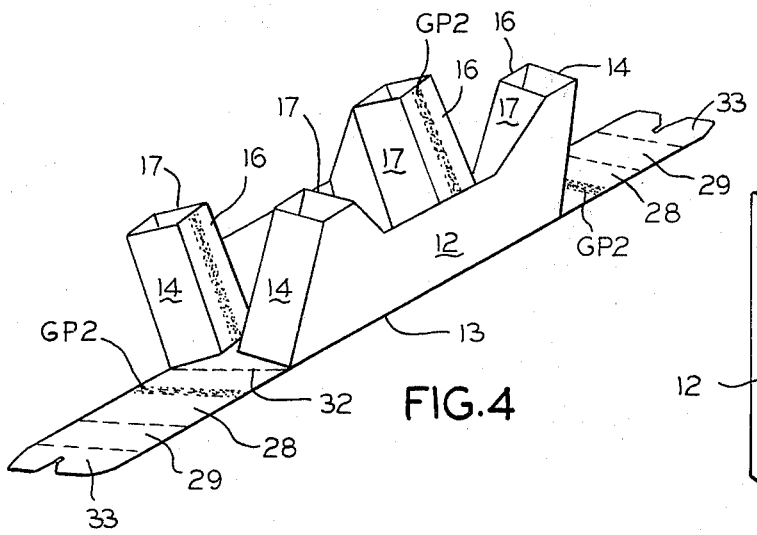
FIG. 4 is an isometric view showing a subsequent step in folding the blank of FIG. 1.
Figure 1:
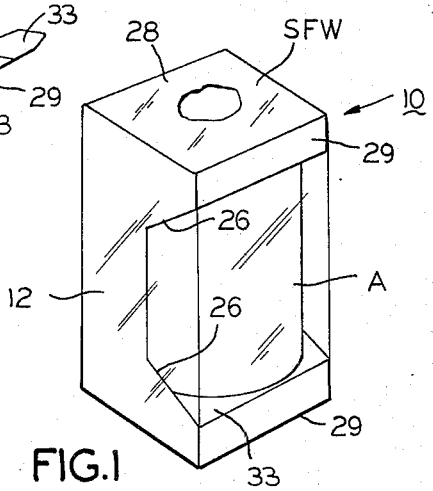
FIG. 1 is an isometric view of the display carton according to the present invention showing an article of merchandise displayed therein.

The blank 10 A then assumes the form seen in FIG. 3, and the forming operation continues. At this time cell forming element 16 is exposed so that glue may be applied if desired, such as shown at glue patch GP2. Glue may also be applied, as shown at GP 2, to the closing flap elements 28, foldably connected to back wall 11 along fold lines 32.

The cells formed by the cell elements 14, 16 and 17 are erected. The side panels 12 together with the cells at each end thereof are also erected with elements 16 in confronting relationship and may be glued together at GP2, if desired.

Closing flap 28 may be glued to cell elements 14 at glue patch GP2. A tab 29 foldably connected to fold line 31 closes over the open ends of the cells now in confronting relationship. A closing tab 33 foldably connected to tab 29 has means, such as locking notch 36, therein which cooperates with a locking notch 37 at the junction between cell elements 16 and 17 to lock in place.

With the carton thus formed the article A is placed between the upper and lower cells formed by the cell elements 14, 16, and 17. By reason of the confronting and joined elements 16, 16 stiffness and stacking strength is given to the upper and lower cells, while less material is used than in the prior art display cartons for similar merchandise. Also, a glue patch GP3 may be applied on panel 33 to enable the tab to be affixed to element 17 instead of tucked in if desired.

While the principles of the invention have been described above in connection with specific apparatus and applications, it is to be understood that this description is made only by way of example, and not as a limitation on the scope of the invention.

I claim:

1. A display carton for an article of merchandise or the like, said carton being formed from a cut and scored blank of paperboard or the like and comprising:

a. a vertical back panel;

b. side panels foldably connected to opposite sides of said back panel;

c. at least three cell forming elements foldably connected to each other and to each of the ends of each said side panel;

d. a distal closing tab foldably connected to each end of said cell forming elements and secured to a correlative side panel and defining with said cell forming elements when erected a cell at each end of each of said side panels, each of said cells having a top, a bottom, open ends and two sides; said side panel, said cells having top sides, open ends and bottom sides;

e. said side panels together with said erected cells being folded to position with a cell forming element of each cell in confronting relationship;

said last named cell forming elements being secured together to define a stiffening rib for a pair of side-by-side cells, and f. a closing flap foldably connected to each end of said back panel and folded to abut said top, bottom, and the open ends of said side-by-side cells foldable to position contiguous to the top and bottom sides and the open ends of said side-by-side cells.

2. The display carton according to claim 1 wherein said closing flap is glued over the top of said cells.

3. The display carton of claim 1 wherein said closing flap has a locking tab foldably connected thereto and in locking relationship with said cell forming elements.

4. A display carton according to claim 3 wherein said locking tab is provided with a locking slot engageable with locking slots on said cell forming elements.

5. The display carton of claim 1 wherein said back panel is solid.

6. A display carton for an article of merchandise and the like, said carton being formed from a cut and scored blank that is substantially rectangular of paperboard or the like, said carton comprising a vertical back panel, said back panel being centrally located in said blank, side panels foldably connected to opposite sides of said back panel, said side panels having shaped cut-out portions at the sides away from said back panel, at least three cell forming elements foldably connected to each other and to each of the ends of each of said side panels, a distal closing tab foldably connected to each end of said cell forming elements and secured to a correlative side panel and defining with said cell forming elements when erected a cell at each end of said side panel, said side panel together with said erected cells being folded to position with a cell forming element of each cell in confronting relationship;

said last named cell forming elements being secured together to define a stiffening rib for a pair of side-by-side cells, and a closing flap foldably connected to each end of said back panel and foldable to position over the top and bottom sides and the open ends of said side-by-side cells.

7. The display carton of claim 6 wherein said shaped cut-out portion is trapezoidal.

8. The display carton according to claim 7 wherein said trapezoidal shaped cut-out portion includes a straight mid-section flanked by oppositely sloping sides.

9. The display carton of claim 6 wherein said closing tabs each have sloping ends which register with the sloping sides of the side panel cut-out portions.

* * * * *

UNITED STATES PATENT OFFICE

CERTIFICATE OF CORRECTION

PATENT NO. : 3,989,139

DATED : November 2, 1976

INVENTOR(S) : JOHN W. VARGO

It is certified that error appears in the above-identified patent and that said Letters Patent are hereby corrected as shown below:

Col. 2, line 19: "to" should be --at--.

Col. 2, lines 56 57, 58 : After "two sides", delete "said side panel, said cells having top sides, open ends and bottom sides;".

Col. 2, line 68 to end of Claim: Delete "foldable to position contiguous to the top and bottom sides and the open ends of said side-by-side cells."

Signed and Sealed this

Twenty-second Day of March 1977

[SEAL]

*Attest:*

RUTH C. MASON
*Attesting Officer*

C. MARSHALL DANN
*Commissioner of Patents and Trademarks*